United States Patent [19]

Northup et al.

[11] 4,232,507

[45] Nov. 11, 1980

[54] APPARATUS AND METHOD FOR WRAPPING CORE YARNS

[75] Inventors: Francis B. Northup; Donald R. Hart, both of Sanford, N.C.

[73] Assignee: Carlo Menegatto, Milan, Italy

[21] Appl. No.: 334,704

[22] Filed: Feb. 22, 1973

[51] Int. Cl.[2] ..... D02G 3/38

[52] U.S. Cl. ..... 57/16

[58] Field of Search ..... 57/3, 10–13, 57/15–18, 160

[56] References Cited

U.S. PATENT DOCUMENTS

| | | | |
|---|---|---|---|
| 1,894,411 | 1/1933 | Nanfeldt | 57/17 |
| 3,382,655 | 5/1968 | Wasserman | 57/160 X |
| 3,439,484 | 4/1969 | Nalpas et al. | 57/160 X |
| 3,667,203 | 6/1972 | Kaschatzky et al. | 57/15 |
| 3,675,409 | 7/1972 | Rosenstein | 57/160 X |
| 3,717,959 | 2/1973 | Chatin | 57/160 |
| 3,732,682 | 5/1973 | Crotty et al. | 57/160 X |

*Primary Examiner*—John W. Huckert
*Assistant Examiner*—Charles Gorenstein
*Attorney, Agent, or Firm*—Mawhinney & Connors

[57] ABSTRACT

Apparatus and method for wrapping core yarns, the apparatus including a plurality of spools driven by a single spindle and the method including the steps of applying two or more layers of wrapped yarn to a core yarn by the use of a minimum number of spindles.

15 Claims, 2 Drawing Figures

APPARATUS AND METHOD FOR WRAPPING CORE YARNS

BACKGROUND, BRIEF SUMMARY AND OBJECTIVES OF THE INVENTION

This invention relates primarily to the high-speed and efficient production of wrapped conventional core yarns and to the production of novelty yarns utilizing the high-speed yarn apparatus and method disclosed.

Covered yarns are frequently used in the production of certain ladies' hosiery products designed primarily to give additional leg or body support. These garments are commonly called support garments and utilize a substantial quantity of spandex core yarns wrapped with one or more layers of relatively small denier preferably multi-filament nylon yarn.

Other wrapped yarns are used for the production of either knitted or woven fabric. A representative yarn of this type is disclosed in U.S. patent application Ser. No. 279,944 filed Aug. 11, 1972, and entitled YARN STRUCTURE AND METHOD OF MAKING SAME.

Whether conventional wrapped spandex yarns or novelty and specialty yarns such as described above are desired, the cost of production is extremely high because of the time required to wrap one or more layers of yarn about the core yarn which in many instances will be from 20 to 80 denier in size. Conventional machinery used to perform the wrapping operation normally employs a number of individual spindles each of which carries a single spool or pirn of wrapping yarn and is driven by an individual drive element. The cost of the wrapping machinery usually depends on the number of separately driven spools included in the mechanism, i.e., the greater number of individual spools, the more expensive the machine.

Since the covered yarn used for support hosiery many times requires at least two layers of wrapped yarn, it is customary to wrap the first layer in, for example, a clockwise direction and apply the second layer in the opposite or a counterclockwise direction. Thus it is necessary to drive the spindle carrying the yarn spool for the first wrapped layer in one direction and drive the spindle carrying the yarn spool for the second wrapped layer in the opposite direction.

The present invention is directed to vastly increasing the speed of the wrapping operation and thus reducing the cost of the wrapping operation and producing wrapped yarn. It is also directed to an improved manufacturing technique for novelty yarns wherein a very high-speed operation is most desirable.

The increased speed is accomplished by positioning two yarn spools on a single spindle and feeding the yarn from the lower spool through the longitudinal center of the spool and the carrying spindle to thus apply two wrapped layers of yarn in the same direction around the core yarn. This will permit doubling the capacity of conventional wrapping machines since two spools are now capable of being carried by each spindle. This results in the production of far less costly conventionally wrapped yarn and novelty and specialty yarn utilizing a cost-saving wrapping process.

Accordingly, an object of the present invention is to provide improved apparatus and procedures for efficiently, rapidly and economically producing conventional and specialty wrapped yarns.

Another object of the present invention is to provide an apparatus capable of accomplishing the above objective.

Yet another object of the present invention is to provide an improved mechanism for wrapping yarn with two wrapping yarn spools for each individually driven spindle in a manner heretofore unknown in the art.

A further object of the present invention is to provide a method of yarn wrapping for conventional and novelty wrapped yarns that will increase efficiency and decrease time and costs in the production thereof.

These and other objects of the present invention will become more apparent after a consideration of the following detailed specification taken in conjunction with the accompanying drawings wherein like characters of reference designate like parts throughout the several views.

FIGURE DESCRIPTION

DETAILED DESCRIPTION OF THE DISCLOSURE

Figure 1:
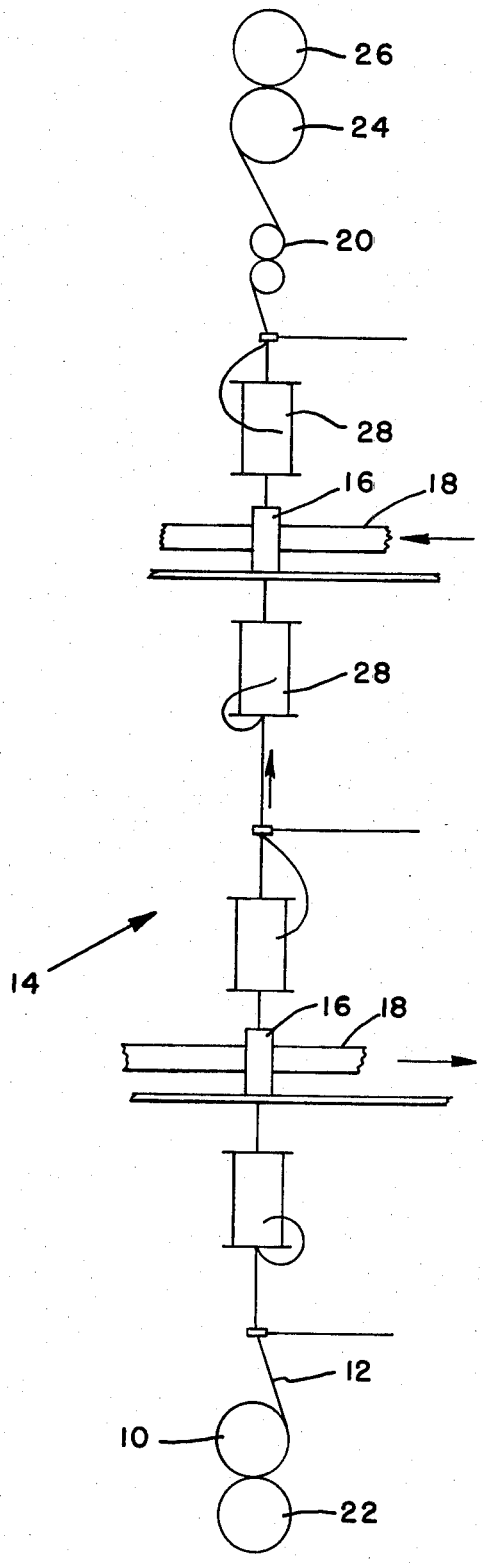
FIG. 1 is a schematic and diagramatic view of the components of the apparatus utilized in producing conventional and novel wrapped yarn wherein a core yarn is wrapped by a plurality of wrapping yarns and the resulting product is accumulated on a collecting roll.

Referring now to the drawings and particularly to FIG. 1, a core yarn 12 wound about a supply spool 10 is moved upwardly (see arrow) from the spool through a wrapping apparatus shown generally as 14 having two separately driven spindles 16 frictionally driven by drive belts 18 in the manner shown. Two nip rolls 20 assist in maintaining a constant tension in the core yarn 12 as it is removed from spool 10 by the action of a driving element 22 associated therewith. A take-up spool 24 is driven by an upper driving element 26 and causes the wrapped yarn to be accumulated for subsequent removal from the apparatus.

Figure 2:
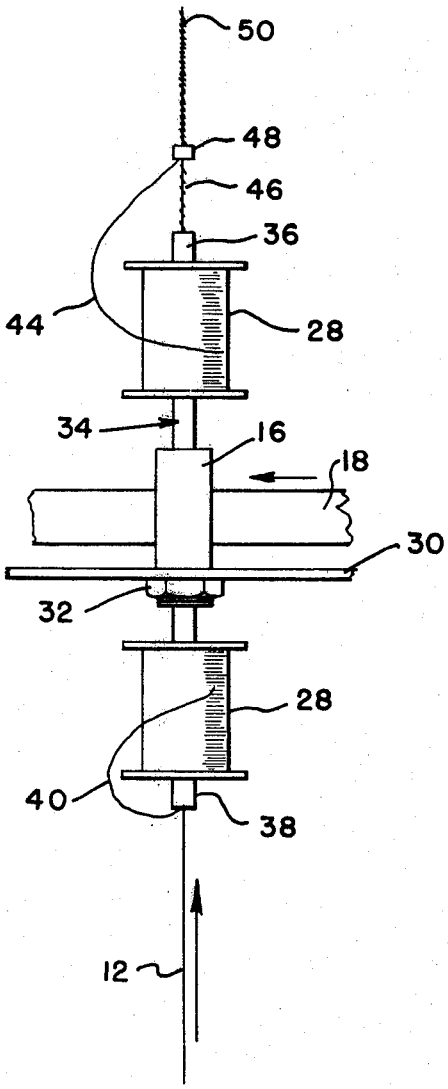
FIG. 2 is an enlarged section of the schematic and diagramatic view of FIG. 1 more particularly illustrating the positioning on a single spindle of two wrapping spools and the manner of applying the layers of wrapped yarn to the core yarn moving therethrough.

Each spindle 16 carries two wrapping yarn spools 28 as shown, and one such spindle is enlarged for a detailed consideration in FIG. 2. Note that the spindle 16 is mounted to the spindle rail 30, a structural component of the frame supporting all of the operating components. The spindle is secured to the frame by any conventional means such as the nut 32 illustrated. The spindle tubular member 34 has a first end 36 and a second end 38 each of which is capable of supporting a wrapping yarn spool 28 in the manner shown. Each spool 28 is releasably secured to an end of the spindle tubular device for rotation therewith.

The wrapping yarn 40 carried by the lower spool 28 feeds from the spool as it rotates, outwardly and downwardly therefrom and then is directed upwardly through the hollow spindle member 34 which extends through the longitudinal hollow axis of spool 28. As core yarn 12 is moved upwardly through the interior of lower spool 28, wrapping yarn 40 is wrapped in one direction about the core yarn. The core yarn with this first wrapped layer emerges from the upper end 36 of spindle tubular member 34 as shown.

Upper spool 28 carries another wrapping yarn 44 which, as spindle 16 is driven, wraps about the core yarn 12 having the first layer 46 of wrapped yarn, as it is directed by guide 48. Winding the wrapping yarn 44 about the first layer of core yarn 12 results in a second layer 50 of wrapped yarn. This second wrapping yarn layer is wrapped in the same direction as the first layer because of the rotational direction of the spools resulting from being driven by a single spindle.

It will be apparent that the addition of another wrapping yarn spool to each spindle of a conventional frame will approximately double the covering capacity of that machine. Two layers of cover yarn will be applied at the first station in one direction and two additional layers of cover yarn will be applied at the second station in the opposite direction. The doubled capacity of such a mechanism may be visualized by the schematic illustration shown in FIG. 1.

Spandex yarn used in the production of support hosiery for women is preferably wrapped with one or more cover layers of fine denier nylon yarn to incorporate desirable characteristics of tension, resiliency, durability and sheerness. The present invention would vastly reduce the cost of this expensive yarn by greatly reducing the production time involved in completing the wrapping operation. Support garments are relatively expensive, and that expense is directly attributable to the wrapped spandex since the wrapping operation currently is a very expensive one.

The present invention has great application in areas of specialty yarn such as that disclosed in U.S. patent application Ser. No. 279,944 filed Aug. 11, 1972, which was mentioned earlier. The yarn disclosed in that application is comprised of a plurality of substantially parallel, untwisted, discontinuous textile fibers which has a single continuous yarn strand wound about these fibers to form spaced-apart helices having uniform directions. That yarn initially has been constructed by applying the wrapping yarn from a single spindle and spool carried thereby, however the present invention can be used far more efficiently since the core yarn, made up of a plurality of substantially parallel, untwisted, discontinuous fibers, can be moved much more rapidly and covered twice as fast by the single spindle carrying two wrapping yarn spools. This specialty yarn promises to be an extremely valuable development since experimentation has shown its performance characteristics to far surpass conventional yarn of comparable size.

Representative examples of yarn disclosed in the referenced application include a core formed from 100% polyester, 3 denier per fiber of three-inch staple length covered by 20 denier 7 filament nylon. Thirty denier and 70 denier cover yarns have been used to cover many brands of polyester, cotton or other fibers equally suitable for making up the core. Good results are obtained where the helices are formed about the roving within the range of 150 to 1,000 per meter.

It is important to note that applying wrapping yarn to a core yarn according to the present invention by apparatus disclosed herein can, as discussed previously, be done to provide two or four or any other even number of wrapped yarn layers about the core. Alternatively, depending upon the speed that the core yarn is moved upwardly through the wrapping stations, the first two wrapping yarns applied in the same direction can be positioned so as to form a single layer. Therefore a single layer can be formed at the first wrapping station by two separate but commonly driven wrapping spools, and a second layer can be applied at the second station in the same manner. Thus the end product yarn can exactly resemble conventional yarn though its production was approximately one half the time necessary for conventional manufacturing.

The method comprising the present invention includes the step of applying two yarns from a single driven spindle carrying two wrapping yarn supplies. It will be apparent that this procedure provides extremely favorable operational efficiencies heretofore unavailable in this highly specialized technical area. Many variations of the present inventive concepts are contemplated and are deemed to be within the spirit and scope of the present disclosure. It is to be understood that the invention is not limited by the specific illustrations set forth herein except to the extent defined in the following claims.

We claim:

1. A method of wrapping a core yarn with a plurality of wrap yarns comprising directing a core yarn in a substantially vertical path of travel and into and through first and second rotating hollow spindles each rotatably carrying a spool of wrap yarn on its opposite ends for wrapping the core yarn passing through the hollow spindles whereby the core yarn will be successively wrapped by the wrap yarns carried by the hollow spindles.

2. A method according to claim 1 wherein each wrap yarn is wrapped in the same direction about the core yarn.

3. A method according to claim 1 wherein the wrap yarns carried by one hollow spindle are wrapping the core yarn in the opposite direction from the wrap yarns carried by the other hollow spindle.

4. A method according to claim 1 wherein the core yarn is formed of substantially parallel untwisted textile fibers.

5. A method of wrapping a core yarn with a plurality of wrap yarns comprising directing a core yarn in a substantially vertical path of travel and into and through a plurality of rotating hollow spindles each rotatably carrying a spool of wrap yarn on its opposite ends for wrapping the core yarn passing through the hollow spindles whereby the core yarn will be successively wrapped by the wrap yarns, and while rotating adjacent hollow spindles in opposite directions whereby the wrap yarns carried by the hollow spindles will successively wrap the core yarn in opposite directions.

6. An apparatus for forming wrapped yarns comprising a horizontally disposed spindle rail, a rotatable hollow spindle substantially vertically mounted on said spindle rail and having its opposite ends extending above and below said spindle rail, a spool of wrap yarn mounted on each of the upper and lower ends of said hollow spindle for rotation therewith, means for rotatably driving said hollow spindle, and means for passing a core yarn through said hollow spindle whereby the core yarn is wrapped by the wrap yarns carried by said spools.

7. An apparatus according to claim 6 wherein said means for driving said hollow spindle comprises a belt.

8. An apparatus for forming wrapped yarns comprising spaced apart horizontally disposed upper and lower spindle rails, a vertically disposed hollow spindle carried by each of said spindle rails in spaced-apart relation and in substantial alignment with each other, each of said hollow spindles having its opposite ends extending above and below its respective spindle rail, spools of wrap yarns carried by the upper and lower ends of the hollow spindles for rotation therewith, and means for rotating said hollow spindles.

9. An apparatus according to claim 8 wherein said rotating means for said hollow spindles imparts rotation to said spindles in opposite directions.

10. An apparatus according to claim 8 wherein said rotating means for said hollow spindles comprises respective belts and wherein the belts impart rotation to one of said hollow spindles in a direction opposite from the direction of rotation being imparted to said other hollow spindle.

11. An apparatus for forming wrapped yarns comprising a plurality of spaced apart horizontally disposed spindle rails, a rotatable hollow spindle substantially vertically mounted on each of said spindle rails and having its opposite ends extending above and below the corresponding spindle rail, a spool of wrap yarn mounted on each of the upper and lower ends of each of said hollow spindles for rotation therewith, means for rotating said hollow spindles and means for passing a core yarn successively through said hollow spindles whereby the core yarn is successively wrapped by the wrap yarns carried by said spools.

12. A unit for covering a continuous core by covering yarns spirally wound on said core, the latter being moved through the axial bore of rotating spindles carrying associated spools of a covering yarn, comprising a first spindle oriented in one direction for carrying a first spool of covering yarn; a second spindle oriented in opposite direction to said one direction for carrying a second spool of covering yarn; and means for interconnecting and rotatably driving the two spindles at the same speed and in the same direction for spirally winding on said core a first covering yarn and a second covering yarn between the previously wound covering yarn coils.

13. A unit as claimed in claim 12, in which the two spindles are coaxial and made fast with each other.

14. A textile machine for covering a continuous core by at least two yarns parallel and spirally wound on said core, comprising a supporting structure for a plurality of spindle units, mutually arranged in overlying pairs, each spindle unit comprising a first spindle oriented in one direction and a second spindle axially oriented in opposite direction and interconnected to the former, and means for controlling the separate rotation of said lower and upper spindle units, respectively.

15. A textile machine as claimed in claim 14, in which one spindle unit in each pair of units is rotatably driven in one direction and the other spindle unit is rotatably driven in the opposite direction to said one direction.

* * * * *